US009675181B2

(12) United States Patent
Caron

(10) Patent No.: US 9,675,181 B2
(45) Date of Patent: Jun. 13, 2017

(54) OBJECT BARRIER FOR PLACEMENT BENEATH AN ITEM OF FURNITURE

(71) Applicant: Mark Caron, Chicago, IL (US)

(72) Inventor: Mark Caron, Chicago, IL (US)

( * ) Notice: Subject to any disclaimer, the term of this patent is extended or adjusted under 35 U.S.C. 154(b) by 0 days.

(21) Appl. No.: 15/015,216

(22) Filed: Feb. 4, 2016

(65) Prior Publication Data

US 2016/0220029 A1 Aug. 4, 2016

Related U.S. Application Data

(60) Provisional application No. 62/111,810, filed on Feb. 4, 2015.

(51) Int. Cl.
*A47D 15/00* (2006.01)
*A47C 17/86* (2006.01)

(52) U.S. Cl.
CPC ..... *A47C 17/86* (2013.01)

(58) Field of Classification Search
CPC ..... A47C 17/86
USPC ..... 297/182
See application file for complete search history.

(56) References Cited

U.S. PATENT DOCUMENTS 618,264 A * 1/1899 Burtless ..... A47C 17/86 297/188.08
2,087,574 A 7/1937 Kaufer
3,695,690 A * 10/1972 Carson ..... A47C 31/11 297/218.3
D243,217 S 2/1977 Warsaw
D246,143 S 10/1977 Nash
D256,634 S 9/1980 Nash
D257,301 S 10/1980 Nash
4,252,372 A * 2/1981 Harder, Jr. ..... B60N 2/242 297/182 X
D258,401 S 3/1981 Beall, Jr.
D305,184 S 12/1989 Coley
D345,658 S 4/1994 Jordan
5,540,480 A * 7/1996 Christa ..... A47C 31/11 297/218.2
D381,216 S 7/1997 Paus
5,676,422 A * 10/1997 White ..... A47C 31/11 297/225
D411,064 S 6/1999 Klein
D424,317 S 5/2000 Natuzzi et al.
6,367,423 B1 * 4/2002 Scheuer ..... A01K 1/035 119/706
D603,192 S * 11/2009 Priddle ..... D6/702
7,805,781 B1 * 10/2010 Smith ..... A47C 17/86 5/280

(Continued)

*Primary Examiner* — Rodney B White
(74) *Attorney, Agent, or Firm* — K&L Gates LLP

(57) ABSTRACT

An object barrier method includes providing a strip of material having a height that can fit beneath an item of furniture, such as a couch or sofa and a length extending from a first front leg to a second front leg of the couch or sofa; enabling a first end of the strip to be releaseably attached to the first leg; and enabling a second end of the strip to be releaseably attached to the first leg. An object barrier having the above structure is provided in which the ends of the strip of material may be provided with releaseably frictional fasteners. Mating releaseably frictional fasteners can also be provided, which are secured to the front legs of the couch or sofa. The frictional fasteners of the strip are then releaseably secured to the frictional fasteners of the legs.

20 Claims, 8 Drawing Sheets

(56) References Cited

U.S. PATENT DOCUMENTS

| | | | | |
|---|---|---|---|---|
| 8,127,379 | B2 * | 3/2012 | Hardee | A44B 18/0046 160/368.1 |
| D663,557 | S * | 7/2012 | Marler | D6/716 |
| 8,465,101 | B1 * | 6/2013 | Alvarez | A47B 95/002 297/182 |
| D718,951 | S | 12/2014 | Hughes | |
| 2003/0137170 | A1 * | 7/2003 | Riley | A47C 31/11 297/228 |
| 2008/0073955 | A1 * | 3/2008 | Illulian | A47C 31/11 297/228 |
| 2015/0076872 | A1 * | 3/2015 | Carithers | B60R 7/043 297/182 |
| 2016/0100695 | A1 * | 4/2016 | Harris | A47C 31/00 428/12 |

* cited by examiner

OBJECT BARRIER FOR PLACEMENT BENEATH AN ITEM OF FURNITURE

PRIORITY CLAIM

This application claims priority to and the benefit of U.S. Provisional Application No. 62/111,810, filed Feb. 4, 2015, entitled "Object Barrier For Furniture Undersides" the entire contents of which are hereby incorporated by reference and relied upon.

CROSS REFERENCE TO RELATED APPLICATION

This application is related in subject matter to U.S. Design Application No. 29/540,480, filed Sep. 24, 2015, entitled "Object Barrier For Underneath Furniture", the entire contents of which are hereby incorporated by reference and relied upon.

BACKGROUND

The present disclosure relates generally to household items and in particular to the prevention of objects from rolling or sliding under couches and sofas.

Missing remote controls are quite often found in sofa cushions or beneath the sofa itself. Many items in fact find their way under the coach, becoming lost or displaced. When placed against a wall especially, objects making their way underneath a couch may be difficult to retrieve.

Parents of small children and pet owners wage an even greater battle with the underside of the couch. Try as they might, small children and pets cannot seem to help themselves from running a toy car or swatting a ball underneath the couch. At the very least, this leads to the stoppage of fun for the child or pet. Quite often, the crying child or pet prompts the parent or owner to have to stop what they are doing, walk over the couch, get down on their knees and fish out the toy. If the parent or owner is lucky, they will be able to reach the toy and will not have to obtain a broomstick or other extension to retrieve the toy. If they are even luckier, they will not have to repeat this exercise before they return to their normal task.

A solution to the above-described problem is needed accordingly.

SUMMARY

The present disclosure in one primary aspect provides an object barrier that extends along the front of the couch or sofa to block objects such as toys, balls and television remotes from rolling or sliding underneath the couch or sofa. The object barrier includes a strip of material having a height small enough to fit underneath most couches. The strip at each end includes a connector. A pair of loose or free connectors is also provided. Each loose or free connector is attached to one of the front legs of the couch or sofa. Each connector of the strip is then releaseably connected to one of the connectors attached to the front legs of the couch or sofa.

In an embodiment, the releaseable connection between the connectors is a frictional connection. One type of frictional connection is a known hook and pile (or loop) connection. Another type of frictional connection includes a plurality of interlocking tabs. A further type of frictional connection includes a tongue and groove connection.

In an embodiment, the connectors located on the ends of the strip of material are adhered to the strip. The connectors can alternatively or additionally be sewn to the strip.

In an embodiment, the loose connectors located on the sofa legs are adhered to the legs. Alternatively or additionally, the loose connectors are tied to the sofa legs.

The material of the strip is a nylon weave in one embodiment. The weave may be a closed weave or an open mesh. In another embodiment, the material is a stretchable material, such as a stretchable fabric. The strip may be made of a single piece of material or be made of multiple pieces of material connected by a buckle or other adjuster, so that the strip is adjustable.

In one embodiment, the strip is cut to a standard couch or sofa size. Connectors, such as frictionally releasable connectors, are placed on either end of the strip. Two loose connectors are provided for the front legs of the couch or sofa. In a second embodiment, the strip is oversized in length for most couches or sofas. Four loose connectors are provided. The user cuts the strip to the correct size for the couch or sofa and attaches, e.g., adheres, the connectors to the ends of the cut strip. In a third embodiment, the strip is again oversized in length for most couches or sofas. Three loose connectors are provided, while a fourth connector is attached to one end of the material strip. The user here attaches the connector-bearing end of the strip to a mating connector attached to one of the front couch legs, and then pulls the material strip tight along a connector attached to the other couch leg to size the strip. The user cuts the strip at the correct length and places the final connector on the second front couch leg to complete the barrier.

In light of the present disclosure, and without limiting the invention in any way, in a first aspect, the present disclosure comprises an object barrier including: a strip of material sized to be placed underneath an item of furniture, such as a couch or sofa, from a first front leg to a second front leg of the couch or sofa; a first frictionally releasable connector located on a first end of the strip of material; a second frictionally releasable connector located on a second end of the strip of material; a first free frictionally releasable connector; and a second free frictionally releasable connector, wherein the first free connector may be attached to the first front leg, the second free connector may be attached to the second front leg, the first strip connector may be releaseably, frictionally connected to the first free/attached connector, and the second strip connector may be releaseably, frictionally connected to the second free/attached connector, so that the strip of material may reside beneath and at the front of the couch or sofa, and extends between the first and second front legs. At the front of the furniture item may mean at the very front or slightly behind the very front, e.g., behind the front legs.

In a second aspect, which may be used in combination with any other aspect listed herein unless specified otherwise, the material of the strip is at least one of elastic, woven or nylon.

In a third aspect, which may be used in combination with any other aspect listed herein unless specified otherwise, the strip is pre-cut to a standard couch or sofa length.

In a fourth aspect, which may be used in combination with any other aspect listed herein unless specified otherwise, the strip is originally longer than a standard couch or sofa and is cut down to a desired length.

In a fifth aspect, which may be used in combination with any other aspect listed herein unless specified otherwise, the material has a height sized to fit beneath the couch or sofa.

In a sixth aspect, which may be used in combination with any other aspect listed herein unless specified otherwise, at least one of the first or second frictionally releasable connectors is pre-attached to the strip.

In a seventh aspect, which may be used in combination with any other aspect listed herein unless specified otherwise, the first and second frictionally releasable connectors are adhered or sewn to the first and second ends of the strip of material, respectively.

In an eighth aspect, which may be used in combination with any other aspect listed herein unless specified otherwise, the third and fourth frictionally releasable connectors are adhered, strapped, or tied to the first and second legs of the sofa or couch, respectively.

In a ninth aspect, which may be used in combination with any other aspect listed herein unless specified otherwise, at least one of the releasable connectors has a plurality of small pegs for engaging like small pegs of a mating connector.

In a tenth aspect, which may be used with the ninth aspect in combination with any other aspect listed herein unless specified otherwise, the small pegs are arranged in non-linear rows.

In an eleventh aspect, which may be used with and any other aspect listed herein unless specified otherwise, at least one of the releasable connectors has a hook or loop configuration.

In a twelfth aspect, which may be used in combination with any other aspect listed herein unless specified otherwise, the strip of material is adjustable in length.

In a thirteenth aspect, which may be used in combination with any other aspect listed herein unless specified otherwise, the width of the frictionally releasable connectors is at least substantially equal to or less than the width of the first and second front legs of the couch or sofa.

In a fourteenth aspect, which may be used with any other aspect listed herein unless specified otherwise, an object barrier includes: a strip of material sized to be placed underneath an item of furniture, such as a couch or sofa, and to be longer than a distance from an outer edge of first front leg to an outer edge of a second front leg of the couch or sofa; a first frictionally releasable connector; a second frictionally releasable connector; a third frictionally releasable connector; and a fourth frictionally releasable connector, wherein the strip of material may be cut to at least substantially equal the distance from the outer edge of first front leg to the outer edge of the second front leg, the first connector may be attached to the first front leg, the second connector may be attached to the second front leg, the third connector may be attached to a first end of the cut strip, the fourth connector may be attached to a second end of the cut strip, whereafter the third connector may be releaseably, frictionally connected to the first connector, and the fourth connector may be releaseably, frictionally connected to the second connector, so that the cut strip of material may reside beneath and at the front of the couch or sofa, and extends between the first and second front legs. Again, at the front of the furniture item may mean at the very front or slightly behind the very front, e.g., behind the front legs.

In a fifteenth aspect, which may be used with the fourteenth aspect in combination with any other aspect listed herein unless specified otherwise, the first and second connectors are adhered to the first and second ends of the strip of material, respectively.

In a sixteenth aspect, which may be used with the fourteenth aspect in combination with any other aspect listed herein unless specified otherwise, at least one of the frictionally releasable connectors has a plurality of small pegs for engaging like small pegs of a mating connector.

In a seventeenth aspect, which may be used with any other aspect listed herein unless specified otherwise, an object barrier includes: a strip of material sized to be placed underneath an item of furniture, such as a couch or sofa, and to be longer than a distance from an outer edge of first front leg to an outer edge of a second front leg of the couch or sofa; a first frictionally releasable connector attached to a first end of the strip of material; a second frictionally releasable connector; a third frictionally releasable connector; and a fourth frictionally releasable connector, wherein the third connector may be attached to the first front leg, the fourth connector may be attached to the second front leg, whereafter the first connector may be releaseably, frictionally connected to the third connector at the first front leg, allowing the strip of material to be pulled across the second leg and then cut to the distance from the outer edge of first front leg to the outer edge of a second front leg, after which the second connector may be attached to the second end of the strip of material and then releaseably, frictionally connected to the fourth connector at the second front leg, so that the cut strip of material may reside beneath and at the front of the couch or sofa, and extends between the first and second front legs. Again, at the front of the furniture item may mean at the very front or slightly behind the very front, e.g., behind the front legs.

In a eighteenth aspect, which may be used with the seventeenth aspect in combination with any other aspect listed herein unless specified otherwise, the first and second connectors are adhered to the first and second ends of the strip of material, respectively.

In a nineteenth aspect, which may be used with the seventeenth aspect in combination with any other aspect listed herein unless specified otherwise, at least one of the frictionally releasable connectors has a plurality of small pegs for engaging like small pegs of a mating connector.

In a twentieth aspect, which may be used with any other aspect listed herein unless specified otherwise, an object barrier method includes: providing a strip of material having a height that can fit beneath an item of furniture, such as a couch or sofa, and a length extending from a first front leg to a second front leg of the couch or sofa; enabling a first end of the strip to be releaseably attached to the first front leg; and enabling a second end of the strip to be releaseably attached to the second front leg.

In a twenty-first aspect, which may be used with any other aspect listed herein unless specified otherwise, at least one of the first frictionally releasable connector located on the first end of the strip or the second frictionally releasable connector located on the second end of the strip is elongated so that the at least one elongated connector and the strip may be cut together down to a desired strip length.

In additional aspects, any of the structure and functionality discussed in connection with FIGS. 1 to 14 may be used in combination with any other aspect or combination of aspects discussed herein.

In light of the present disclosure and above aspects, it is accordingly an advantage of the present disclosure to prevent objects from rolling or sliding beneath a couch or sofa.

It is another advantage of the present disclosure to provide an object barrier that is easy to install.

It is a further advantage of the present disclosure to provide an object barrier that is non-permanent, and may be easily removed when desired.

It is yet a further advantage of the present disclosure to provide an object barrier that is relatively inexpensive.

Additional features and advantages are described herein, and will be apparent from, the following Detailed Description and the figures.

DETAILED DESCRIPTION

Figure 1:
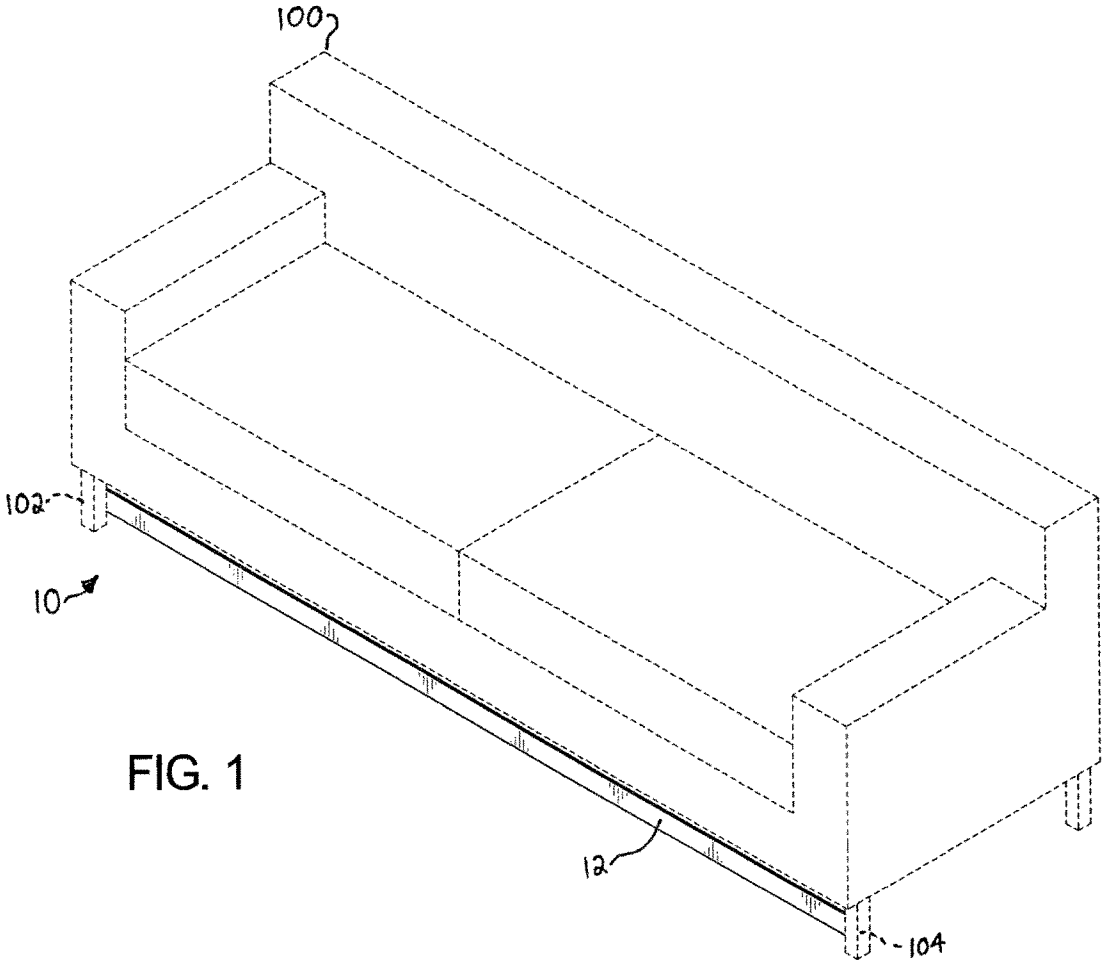
FIG. 1 is a front, perspective view of one embodiment for an object barrier of the present disclosure attached to a couch or sofa.

Referring now to the drawings and in particular to FIGS. 1 to 6, an embodiment of object barrier 10 is illustrated. FIG. 1 illustrates object barrier 10 connected removeably to an item of furniture, such as a couch or sofa 100. As illustrated, object barrier 10 is located beneath sofa 100. In the illustrated embodiment, object barrier 10 is attached to rear or back sides of first and second front legs 102 and 104 of couch 100. Alternatively, object barrier 10 may be attached to the front sides of first and send front legs 102 and 104. Attaching barrier 10 to the rear sides of front legs 102 and 104 is advantageous, however, because barrier 10 is then less visible and more out of the way. To this end, barrier 10 is black in one implementation.

It has been found that to a large extent, certain dimensions of couch or sofa 100 are standardized. For example, the length from the outside of front leg 102 to the outside of front leg 104 of eighty-four inches (213.4 centimeters ("cm")) is the same for many couches or sofas. The height from the ground to the bottom of the couch or sofa of about three inches (7.62 cm) is the same for many couches or sofas. It is therefore contemplated to make a material strip 12 of barrier 10 eighty-four inches (213.4 cm) long by two inches (5.08 cm) high in one embodiment. The two inch (5.08 cm) height allows for a clearance space to exist between barrier 10 and couch 100 and for the gap between the couch and the floor to be less than three inches (7.62 cm).

Figure 3:
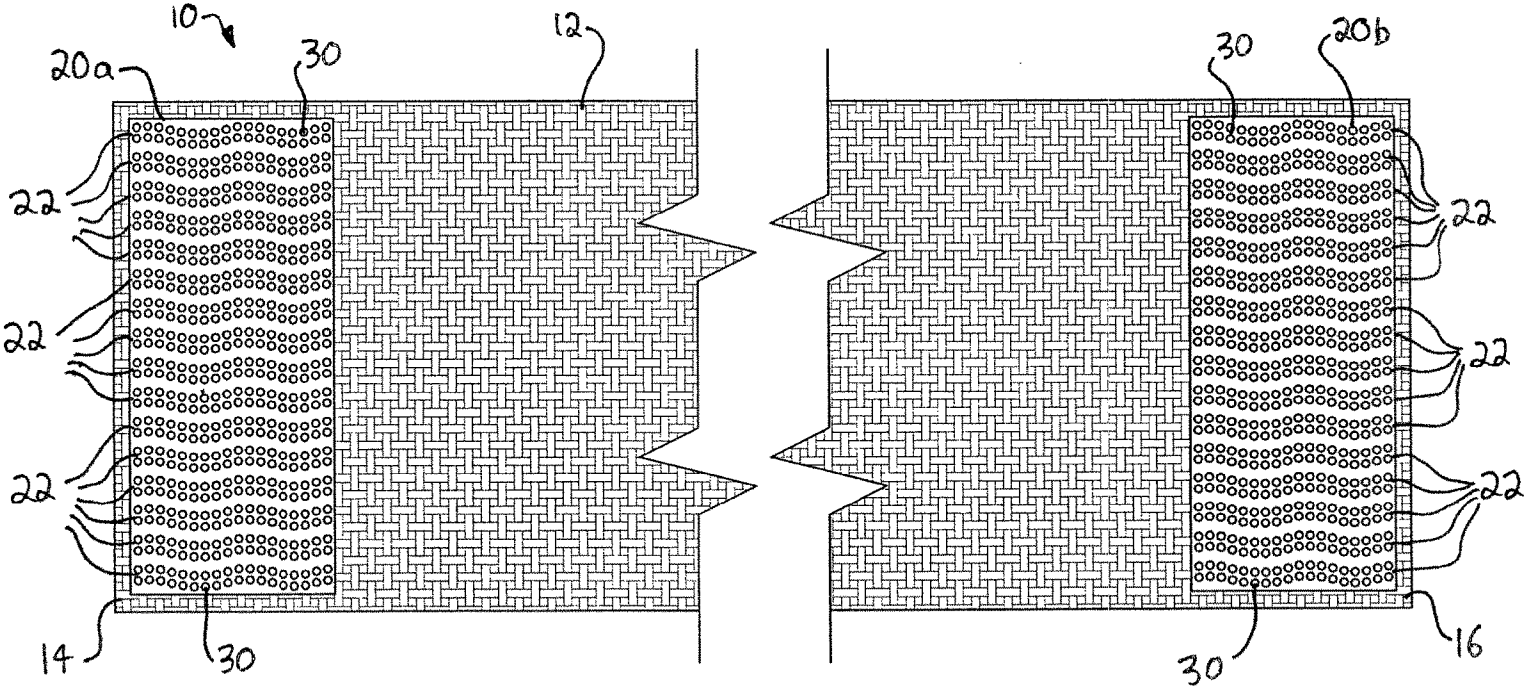
FIG. 3 is a sectioned, front elevation view of one embodiment for an object barrier of the present disclosure showing the ends thereof in detail.
Figure 4:
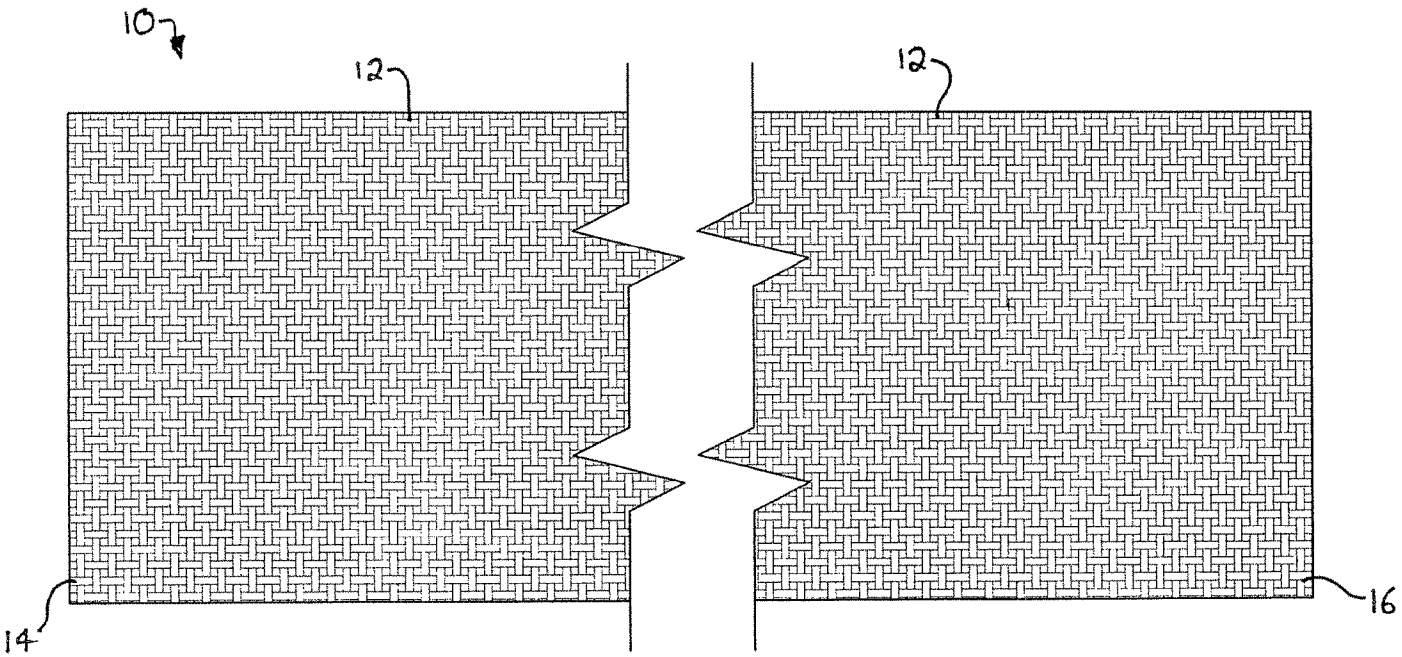
FIG. 4 is a sectioned, back elevation view of one embodiment for an object barrier of the present disclosure showing the ends thereof.

Material strip 12 (or 112, see FIGS. 10 to 14) may be a woven or extruded material plastic, rubber or fabric. A material that may be rolled-up or folded is advantageous for packaging purposes. Material strip 12 (or 112) may be a woven fabric, such as nylon, as illustrated in FIGS. 3 and 4. Material strip 12 (or 112) may be closed or solid, or alternatively be open mesh. Material strip 12 (or 112) may be stretchable if desired. In an embodiment, material strip 12 (or 112) may be black in color such that the presence of object barrier tends to go unnoticed. Material strip 12 (or 112) may also have one or more interior buckles or adjuster (not illustrated), such as a standard loop adjuster found on backpacks and the like, enabling the length of strip 12 (or 112) to be adjusted.

Figure 2:
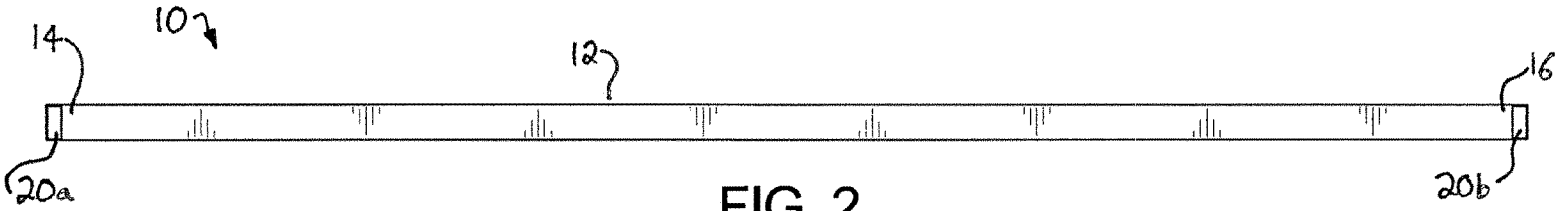
FIG. 2 is a front elevation view of one embodiment for an object barrier of the present disclosure.

FIG. 2 shows the entire object barrier 10, while FIG. 3 illustrates object barrier 10 up close, where its middle section has been cutaway so that ends 14 and 16 of material strip 12 may be illustrated in detail. FIGS. 2 and 3 illustrate that each end 14 and 16 includes a connector 20 (referring generally or collectively to connectors 20*a* to 20*d*). Connectors 20*a* to 20*d* may be made of any of the materials discussed above for material strip 12. Connectors 20*a* to 20*d* can have additional plastic or metal layer for rigidity if desired. End 14 includes connector 20*a*, while end 16 includes a connector 20*b*. Connectors 20*a* and 20*b* may be mechanically and/or adhesively connected to ends 14 and 16, respectively. For example, connectors 20*a* and 20*b* may be glued, heat sealed, and/or sewn to ends 14 and 16, respectively, of strip 12.

Figure 5:
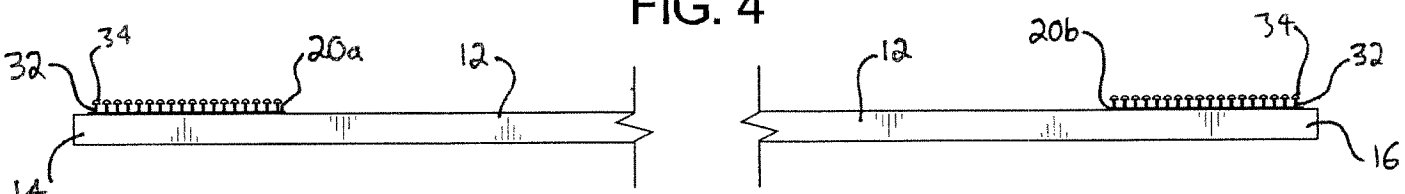
FIG. 5 is a sectioned, top or bottom view of one embodiment for an object barrier of the present disclosure showing the ends thereof in detail.
Figure 6:
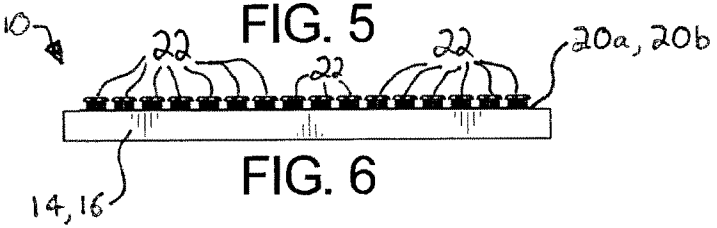
FIG. 6 is a side view of one embodiment for an object barrier of the present disclosure showing the ends thereof in detail.

FIGS. 3, 5 and 6 illustrate that connectors 20 (20*a* to 20*d*) can have pegs 30 arranged in rows 22. Rows 22 may be linear or, as illustrated, non linear. Pegs 30 as illustrated each include a stem 32 and a cap 34. Caps 34 snap past caps 34 and wedge within the stems 32 of pegs 30 of a mating connector 20, when two connectors 20*a* to 20*d* are pressed together. In this manner, the two mated connectors are frictionally but releaseably held together, so that the mated connectors may be pulled apart when desired.

It is contemplated for connectors 20*a* to 20*d* to be frictionally and releaseably mated in alternative ways. For example connectors may be alternatively releaseably attached via one connector 20 having a hook surface, while the other connector 20 has a pile (or loop) surface. Connectors 20*a* to 20*d* can further alternatively be releaseably attached via one connector 20 having a tongue surface, while the other connector 20 has a mating groove surface.

FIGS. 3, 5 and 6 illustrate that first and second connectors 20*a* and 20*b* may be provided with or attached to material strip 12. Third and fourth connectors 20*c* and 20*d* in an embodiment are provided initially as loose or free pieces. That is, out of the package, third and fourth connectors 20*c* and 20*d* are not attached to anything and are attached instead by the user to front couch or sofa legs 102 and 104. It is contemplated to adhere and/or mechanically attach third and fourth connectors 20*c* and 20*d* to legs 102 and 104 as described in more detail in connection with FIGS. 7 to 9.

Figure 7:
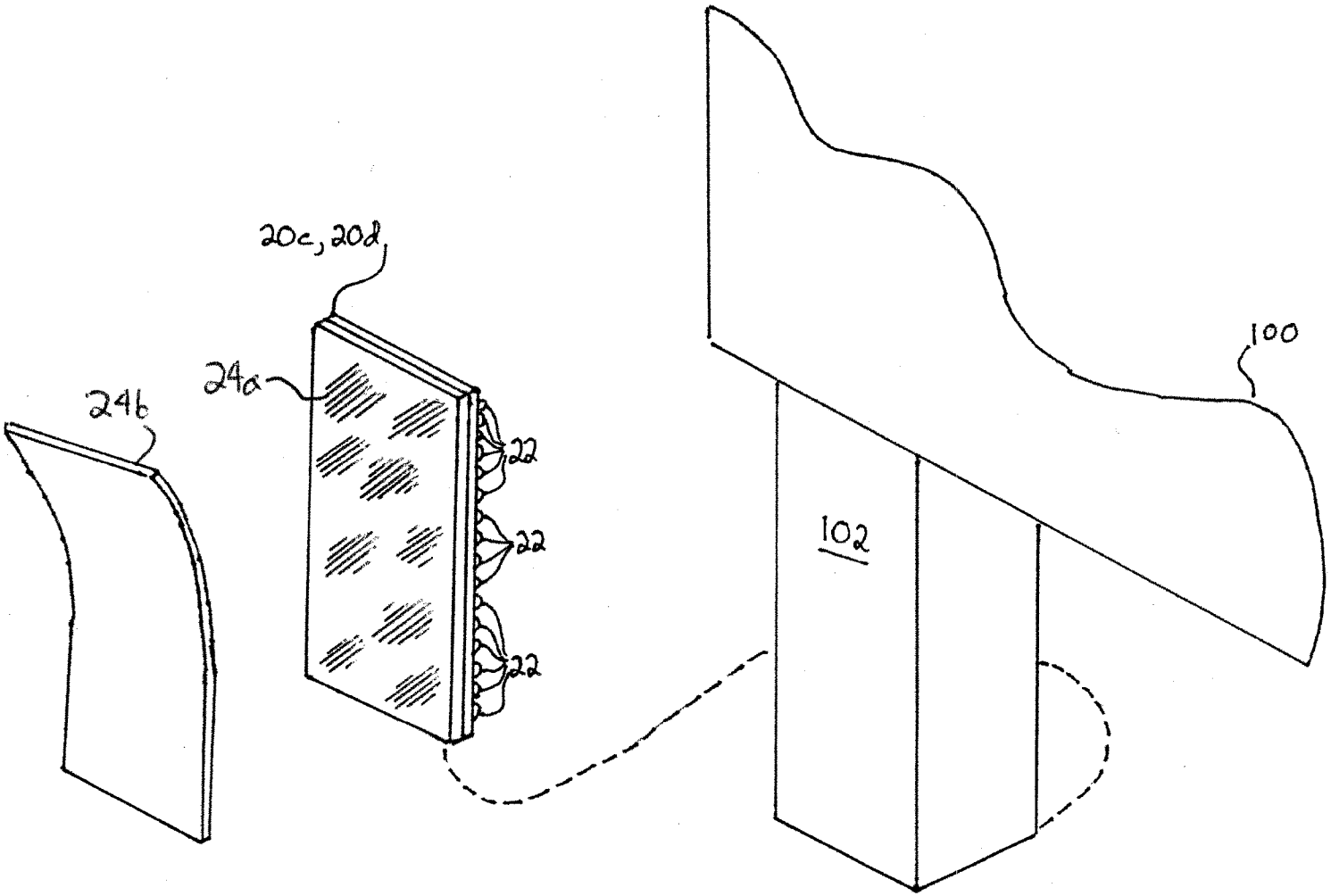
FIG. 7 is a perspective view of one embodiment for attaching a connector of the object barrier of the present disclosure to a front couch or sofa leg.

FIG. 7 illustrates an embodiment in which third and/or fourth connector 20*c* or 20*d* includes an adhesive backing 24*a*. Adhesive backing 24*a* may be rigid, semi-rigid, or flexible in various embodiments. A peelable cover 24*b* is provided initially on adhesive backing 24*a*. When the user wants to apply third or fourth connector 20*c* or 20*d* to front couch or sofa legs 102 and 104, the user removes peelable cover 24*b* from adhesive backing 24*a* of third or fourth connector 20*c* or 20*d*, and then adheres the third or fourth connector 20*c* or 20*d* to front couch or sofa leg 102 or 104. In the illustrated embodiment, front couch or sofa legs 102 and 104 are relatively flat, providing a suitable surface against which to adhere third or fourth connector 20*c* or 20*d*. The width of connectors 20*c*, 20*d* may be at least substantially equal to or less than the width of legs 102 and 104. Flexible adhesive backing can also adhere to curved couch or sofa legs 102 and 104.

Figure 8:
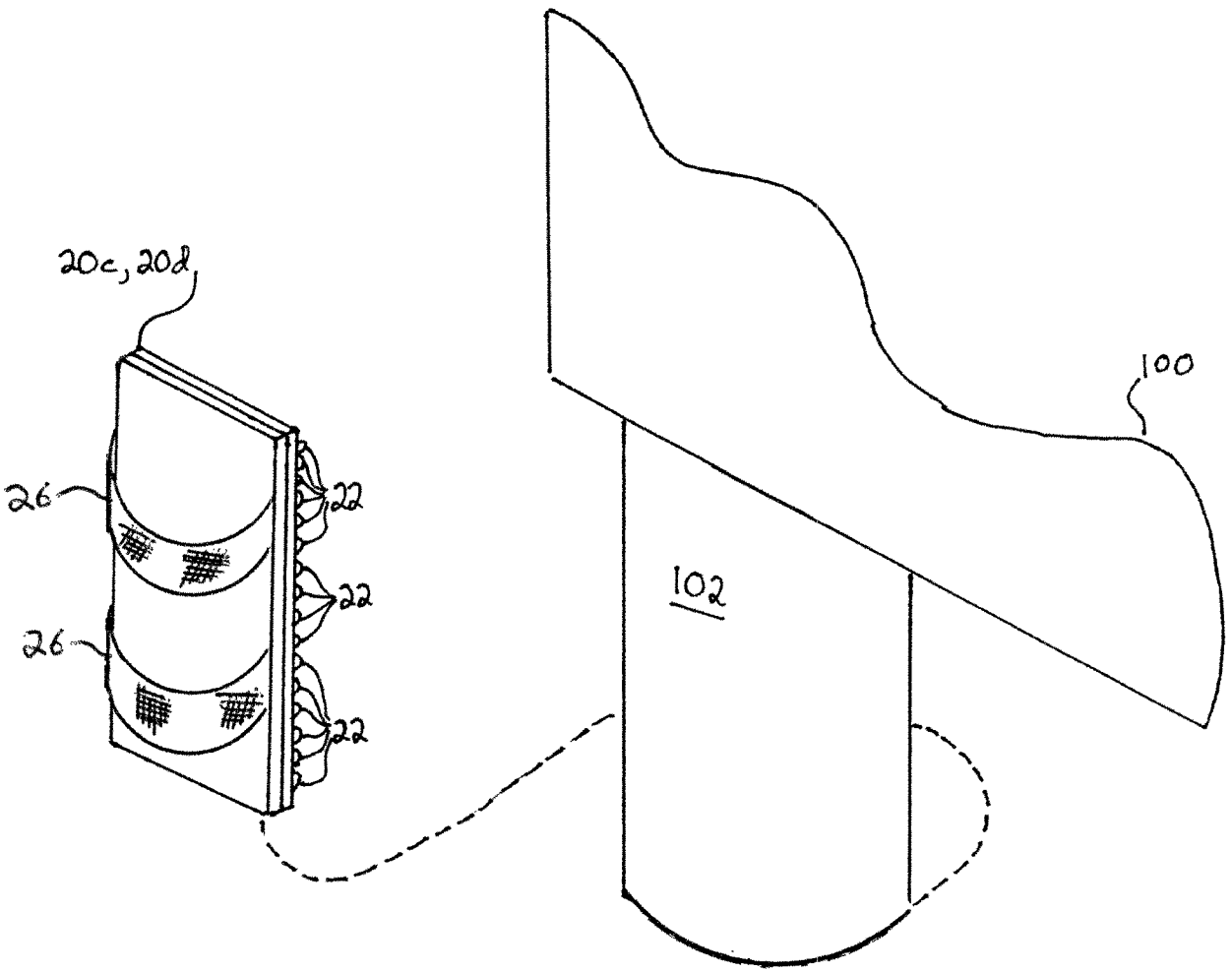
FIG. 8 is a perspective view of another embodiment for attaching a connector of the object barrier of the present disclosure to a front couch or sofa leg.

FIG. 8 illustrates an alternative embodiment in which third and/or fourth connector 20*c* or 20*d* includes one or more bands 26 that elastically stretch to fit around front couch or sofa legs 102 and 104. Once bands are stretched around front couch or sofa legs 102 and 104, the user releases bands 26, which then snap back to their original shape to compress against legs 102 and 104, so that third or fourth connectors 20*c* or 20*d* are fitted tightly to the legs. Front couch or sofa legs 102 and 104 may be rounded or flat, wherein bands 26 can fit tightly and sealingly to the rounded or flat sofa legs 102 and 104. Bands 26 may be provided in combination with adhesive backing 24*a* and peelable cover 24*b*.

Figure 9:
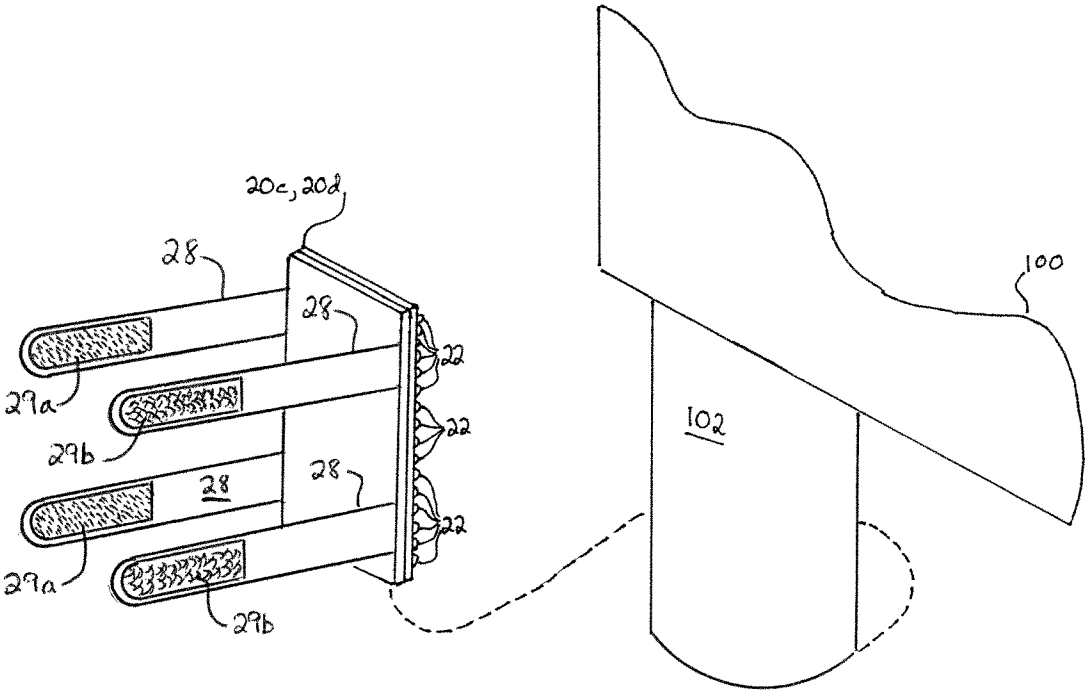
FIG. 9 is a perspective view of a further embodiment for attaching a connector the object barrier of the present disclosure to a front couch or sofa leg.

FIG. 9 illustrates a further alternative embodiment in which third and/or fourth connector 20*c* or 20*d* includes one or more ties 28 that wrap around front couch or sofa legs 102 and 104. Once ties 28 are wrapped around front couch or sofa legs 102 and 104, the user ties wraps or mechanically closes ties 28 tightly about legs 102 and 104, e.g., via a hook 29*a* and pile (or loop) 29*b* connection, so that third or fourth connectors 20*c* or 20*d* are fitted tightly to the legs. Front couch or sofa legs 102 and 104 may be flat or rounded, wherein ties 28 are attached tightly and sealingly to the rounded or flat sofa legs 102 and 104. Ties 28 can also be provided in combination with adhesive backing 24*a* and peelable cover 24*b*.

It is contemplated for object barrier 10 to be provided with material strip 12 cut to its standard size, e.g., eighty-four inches (213.4 cm) long by two inches (5.08 cm) high. Here, material strip 12 is provided with both first and second connectors 20*a* and 20*b* pre-attached to material strip 12 in any manner described above. The user attaches third and fourth connectors 20*c* or 20*d* to front couch or sofa legs 102 and 104 in any manner described above. The user then removeably and frictionally connects first and second connectors 20*a* and 20*b* to third and fourth connectors 20*c* and 20*d*, installing object barrier beneath couch or sofa 100.

In alternative embodiment, object barrier 10 is provided with material strip 12 cut to be larger than its standard size, e.g., larger than eighty-four inches (213.4 cm) long, but cut to its desired height, e.g., two inches (5.08 cm) high. In one implementation, material strip 12 is provided with neither first nor second connector 20*a* and 20*b* pre-attached to material strip 12. Instead, the user cuts material strip 12 to whatever length is needed, e.g., equal to, more, or less than, eighty-four inches (213.4 cm) long. The user attaches, e.g., adheres, first and second strip connectors 20*a* and 20*b* to ends 14 and 16 of the user-cut material strip 12. To this end, connectors 20*a* and 20*b* may be provided with adhesive backing 24*a* and peelable cover 24*b* described above in connection with FIG. 7. The user attaches third and fourth connectors 20*c* or 20*d* to front couch or sofa legs 102 and 104 in any manner described above. The user then removeably and frictionally connects first and second connectors 20*a* and 20*b* to third and fourth connectors 20*c* and 20*d*, installing object barrier beneath couch or sofa 100.

In a further alternative embodiment, object barrier 10 is again provided with material strip 12 cut to be larger than its standard size, e.g., larger than eighty-four inches (213.4 cm) long, but cut to its desired height, e.g., two inches (5.08 cm) high. In a second implementation, material strip 12 is provided with one of first or second connector 20*a* and 20*b* pre-attached to one of the ends 14 and 16 of material strip 12, which is performed in any manner described above. The user attaches third and fourth connectors 20*c* or 20*d* to front couch or sofa legs 102 and 104 in any manner described above. The user removeably and frictionally connects the pre-attached first or second connector 20*a* and 20*b* to one of third and fourth connectors 20*c* and 20*d*, stretches material strip 12 across couch or sofa 100 and the remaining connector 20*c* or 20*d*, and cuts the free end 14 or 16 of material strip 12, so that the cut free end mates with the remaining connector 20*c* or 20*d*. The user attaches, e.g., adheres, the final free connector 20*a* or 20*b* to the cut free end 14 or 16 of material strip 12. To this end, the final free connector 20*a* or 20*b* may be provided with adhesive backing 24*a* and peelable cover 24*b*. The user then removeably and frictionally connects the just-installed first or second connector 20*a* and 20*b* to the open third or fourth connector 20*c* or 20*d* attached to leg 102 or 104, installing object barrier beneath couch or sofa 100.

FIGS. 10 to 14 illustrate an alternative object barrier 110, which includes first and second connectors 120*a* and 120*b* that are provided with or attached to material strip 112. Third and fourth connectors 20*c* and 20*d* discussed above may again be provided initially as loose or free pieces for operation with object barrier 110. That is, out of the package for object barrier 110, third and fourth connectors 20*c* and 20*d* are again not attached to anything and are attached instead by the user to front couch or sofa legs 102 and 104. It is contemplated likewise for object barrier 110 to adhere and/or mechanically attach third and fourth connectors 20*c* and 20*d* to legs 102 and 104 as described in more detail above in connection with FIGS. 7 to 9.

Figure 10:
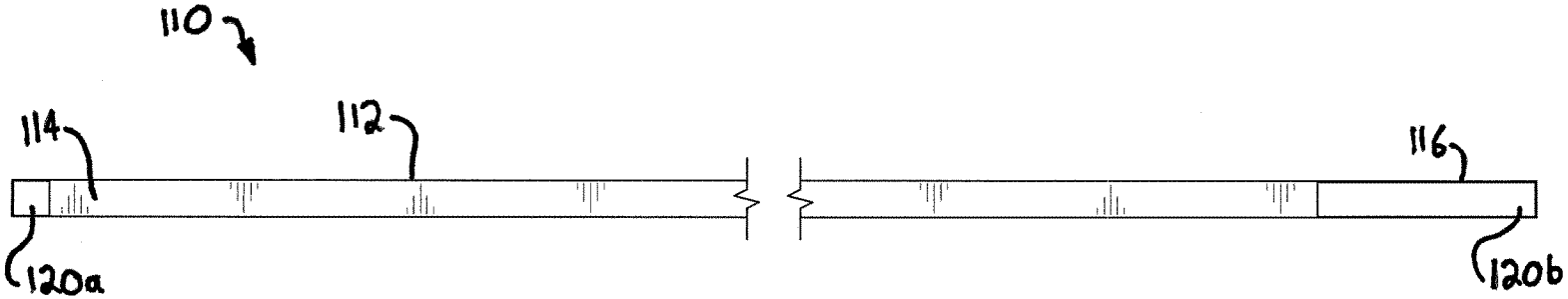
FIG. 10 is a front elevation view of another embodiment for an object barrier of the present disclosure.
Figure 11:
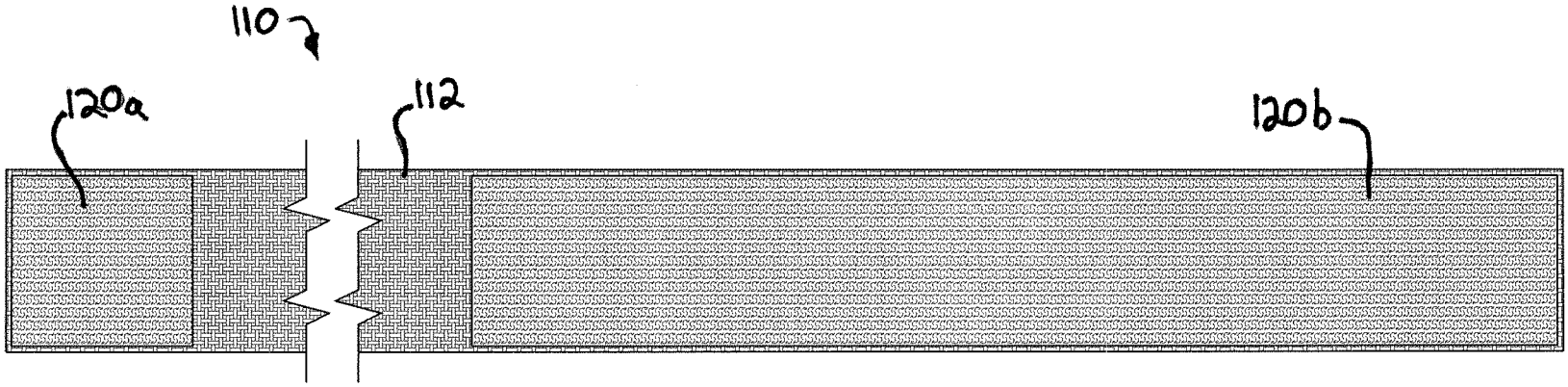
FIG. 11 is a sectioned, front elevation view of the FIG. 10 embodiment for an object barrier of the present disclosure showing the ends thereof in detail.
Figure 12:
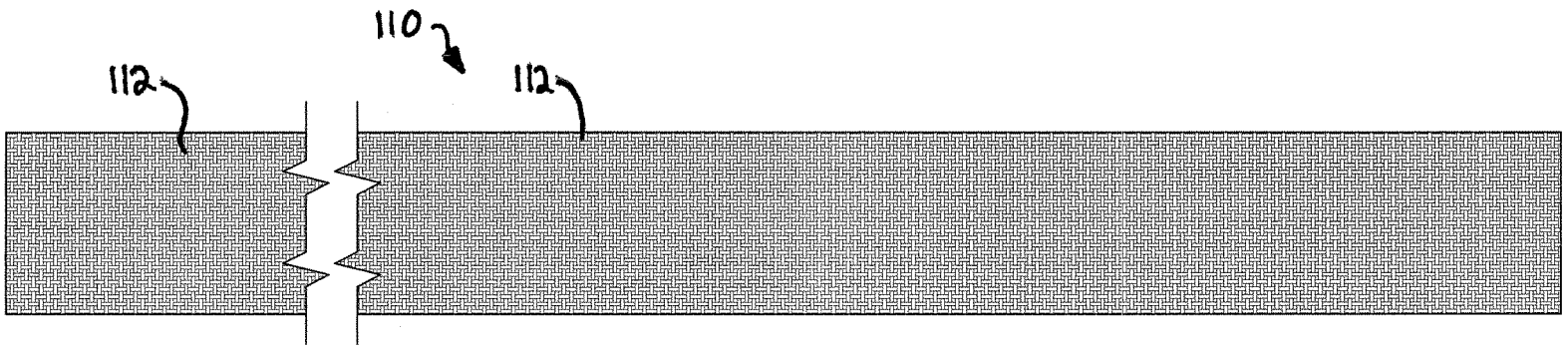
FIG. 12 is a sectioned, back elevation view of the FIG. 10 one embodiment for an object barrier of the present disclosure showing the ends thereof.

FIG. 10 shows the entire object barrier 110, while FIG. 11 illustrates object barrier 110 up close, where its middle section has been cutaway so that ends 114 and 116 of material strip 112 may be illustrated in detail. FIGS. 10 and 11 illustrate that each end 114 and 116 includes a connector 120 (referring generally or collectively to connectors 120*a* and 120*b*). Connectors 120*a* and 120*b* may be made of any of the materials discussed above for material strip 12/112. Connectors 120*a* and 120*b* can have additional plastic or metal layer for rigidity if desired. End 114 includes a connector 120*a*, while end 116 includes a connector 120*b*. Connectors 120*a* and 120*b* may be mechanically and/or adhesively connected to ends 14 and 16, respectively. For example, connectors 120*a* and 120*b* may be glued, heat sealed, and/or sewn to ends 14 and 16, respectively, of strip 12.

Figure 13:
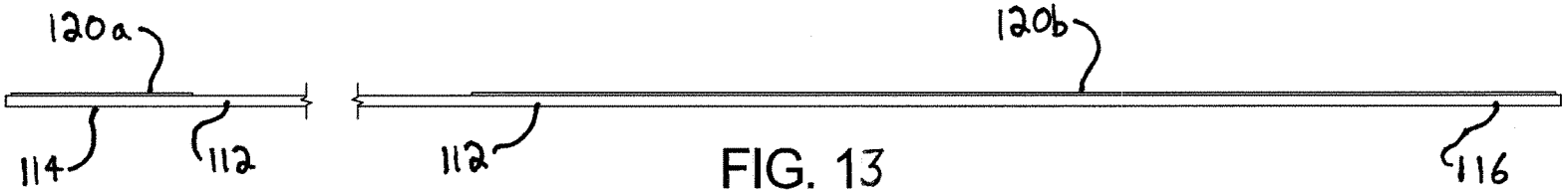
FIG. 13 is a sectioned, top or bottom view of the FIG. 10 embodiment for an object barrier of the present disclosure showing the ends thereof in detail.
Figure 14:
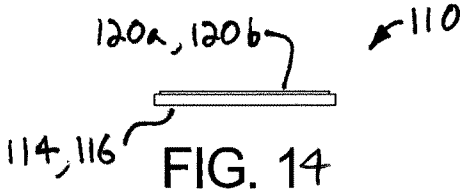
FIG. 14 is a side view of the FIG. 10 embodiment for an object barrier of the present disclosure showing the ends thereof in detail.

FIGS. 11, 13 and 14 illustrate that connectors 120 (120*a* and 120*b*) may be made of a hook or pile material (but could alternatively have rows 22 of pegs 30 as described above). It is contemplated for connectors 120*a*, 120*b*, 20*c* and 20*d* to be frictionally and releaseably mated in alternative ways, such as 120*a*, 120*b* have hook material, while connectors 20*c* and 20*d* have pile material, or vice versa. Connectors 20*a*, 120*b*, 20*c* and 20*d* may further alternatively be releaseably attached via one connector 20 having a tongue surface, while the other connector 20 has a mating groove surface.

The primary difference between object barrier 110 and object barrier 10 is that material strip 112 for object barrier 110 is oversized, e.g., larger than eighty-four inches (213.4 cm). Material strip 112 for object barrier 110 may for example be a foot longer, ninety-six inches (243.8 cm) to fit larger couches, but which can be cut as needed to be tailored to regular or smaller size couches 100. In the illustrated embodiment of FIGS. 11 and 13, end 116 of material strip 112 has an elongated connector 120*b*, which may for example be twelve inches (30.5 cm) long of hook or pile material. The center of the twelve inch connector 120*b* may be placed at the eighty-four inch (213.4 cm) mark to provide six inches (15.2 cm) of shorter and longer variance from the standard eighty-four inch (213.4 cm) couch. Elongated connector 120*b* may have a different length and have its center placed at different locations along strip 112 as desired.

In a further alternative embodiment, both connectors 120*a* and 120*b* may be enlarged or elongated, e.g., made to be longer than a typical width (e.g., two inches (5.1 cm)) of front legs 102 and 104 of couch 100. Here, either or both connectors 120*a* and 120*b* may be cut so that strip has a desired and tailored overall length.

Material strip 112 of barrier 110 may again be two inches (5.08 cm) high in one embodiment. The two inch (5.08 cm) height allows for a clearance space to exist between barrier 110 and couch 100 and for the gap between the couch and the floor to be less than three inches (7.62 cm).

It should be understood that various changes and modifications to the presently preferred embodiments described herein will be apparent to those skilled in the art. Such changes and modifications may be made without departing from the spirit and scope of the present subject matter and without diminishing its intended advantages. It is therefore intended that such changes and modifications be covered by the appended claims.

The invention is claimed as follows:

1. An object barrier comprising:

a strip of material sized to be placed beneath an item of furniture from a first front leg to a second front leg of the furniture item;

a first frictionally releasable connector located on a first end of the strip of material;

a second frictionally releasable connector located on a second end of the strip of material, leaving a middle section of the strip of material free of the first and second frictionally releasable connectors;

a first free frictionally releasable connector; and a second free frictionally releasable connector, wherein the first free connector is configured to be attached to the first front leg, the second free connector is configured to be attached to the second front leg, the first strip connector is configured to be releaseably, frictionally connected to the first free/attached connector, and the second strip connector is configured to be releaseably, frictionally connected to the second free/attached connector, so that the strip of material is releaseably connectable beneath and at the front of the furniture item, extending between the first and second front legs.

2. The object barrier of claim 1, wherein the material of the strip is at least one of elastic, woven or nylon.

3. The object barrier of claim 1, wherein the strip is pre-cut to a standard furniture item length.

4. The object barrier of claim 1, wherein the strip is originally longer than a standard for the furniture item and is cut down to a desired length.

5. The object barrier of claim 1, wherein the material has a height sized to fit beneath the furniture item.

6. The object barrier of claim 1, wherein at least one of the first or second frictionally releasable connectors is pre-attached to the strip.

7. The object barrier of claim 1, wherein the first and second frictionally releasable connectors are adhered or sewn to the first and second ends of the strip of material, respectively.

8. The object barrier of claim 1, wherein the third and fourth frictionally releasable connectors are adhered, strapped, or tied to the first and second legs of the furniture item, respectively.

9. The object barrier of claim 1, wherein at least one of the releasable connectors has a plurality of small pegs for engaging small pegs of a mating connector.

10. The object barrier of claim 1, wherein at least one of the first frictionally releasable connector located on the first end of the strip or the second frictionally releasable connector located on the second end of the strip is elongated so that the at least one elongated connector and the strip may be cut together down to a desired strip length.

11. The object barrier of claim 1, wherein at least one of the releasable connectors has a hook or loop configuration.

12. The object barrier of claim 1, wherein the strip of material is adjustable in length.

13. The object barrier of claim 1, wherein the width of the frictionally releasable connectors is at least substantially equal to or less than the width of the first and second front legs of the furniture item.

14. An object barrier comprising:

a strip of material sized to be placed beneath a item of furniture and to be longer than a distance from an outer edge of first front leg to an outer edge of a second front leg of the furniture item;

a first frictionally releasable connector;

a second frictionally releasable connector;

a third frictionally releasable connector; and a fourth frictionally releasable connector, wherein the strip of material is configured to be cut to at least substantially equal the distance from the outer edge of first front leg to the outer edge of the second front leg, the first connector is configured to be attached to the first front leg, the second connector is configured to be attached to the second front leg, the third connector is configured to be attached to a first end of the cut strip, the fourth connector is configured to be attached to a second end of the cut strip, leaving a middle section of the cut strip of material free of the third and fourth connectors, whereafter the third connector is configured to be releaseably, frictionally connected to the first connector, and the fourth connector is configured to be releaseably, frictionally connected to the second connector, so that the cut strip of material is releaseably connectable beneath and at the front of the furniture item, extending between the first and second front legs.

15. The object barrier of claim 14, wherein the first and second connectors are adhered to the first and second ends of the strip of material, respectively.

16. The object barrier of claim 14, wherein at least one of the frictionally releasable connectors has a plurality of small pegs for engaging small pegs of a mating connector.

17. An object barrier comprising:

a strip of material sized to be placed beneath an item of furniture and to be longer than a distance from an outer edge of a first front leg to an outer edge of a second front leg of the furniture item;

a first frictionally releasable connector attached to a first end of the strip of material;

a second frictionally releasable connector;

a third frictionally releasable connector; and a fourth frictionally releasable connector, wherein the third connector is configured to be attached to the first front leg, the fourth connector is configured to be attached to the second front leg, whereafter the first connector is configured to be releaseably, frictionally connected to the third connector at the first front leg, allowing the strip of material to be pulled across the second leg and then cut to the distance from the outer edge of first front leg to the outer edge of a second front leg, after which the second connector is configured to be attached to the second end of the strip of material so that a middle section of the strip is free of the first and second connectors and then releaseably, frictionally connected to the fourth connector at the second front leg, so that the cut strip of material is releaseably connectable beneath and at the front of the furniture item, extending between the first and second front legs.

18. The object barrier of claim 17, wherein the first and second connectors are adhered to the first and second ends of the strip of material, respectively.

19. The object barrier of claim 17, wherein at least one of the frictionally releasable connectors has a plurality of small pegs for engaging small pegs of a mating connector.

20. An object barrier comprising:

a strip of material sized to be placed beneath an item of furniture from a first front leg to a second front leg of the furniture item;

a first frictionally releasable connector located on a first end of the strip of material;

a second frictionally releasable connector located on a second end of the strip of material, leaving a middle section of the strip of material free of the first and second frictionally releasable connectors, the second frictionally releasable connector longer than the first frictionally releasable connector;

a first free frictionally releasable connector; and a second free frictionally releasable connector, wherein the first free connector is configured to be attached to the first front leg, the second free connector is configured to be attached to the second front leg, the first strip connector is configured to be releaseably, frictionally connected to the first free/attached connector, and the second strip connector is configured to be cut to a desired length and releaseably, frictionally connected to the second free/attached connector, so that the strip of material is releaseably connectable beneath and at the front of the furniture item, extending between the first and second front legs.

* * * * *